US006792915B2

(12) United States Patent
Rembold et al.

(10) Patent No.: US 6,792,915 B2
(45) Date of Patent: Sep. 21, 2004

(54) FUEL SUPPLY APPARATUS FOR AN INTERNAL COMBUSTION ENGINE

(75) Inventors: Helmut Rembold, Stuttgart (DE); Karl Gmelin, Flein (DE); Volkmar Goldschmitt, Asperg (DE); Jens Wolber, Gerlingen (DE); Mathias Schumacher, Asperg (DE); Edmund Schaut, Friolzheim (DE); Uwe Mueller, Hemmingen (DE); Markus Amler, Leonberg-Gebersheim (DE)

(73) Assignee: Robert Bosch GmbH, Stuttgart (DE)

( * ) Notice: Subject to any disclaimer, the term of this patent is extended or adjusted under 35 U.S.C. 154(b) by 244 days.

(21) Appl. No.: 09/928,862

(22) Filed: Aug. 13, 2001

(65) Prior Publication Data

US 2002/0092505 A1 Jul. 18, 2002

(30) Foreign Application Priority Data

Aug. 16, 2000 (DE) ..... 100 39 773

(51) Int. Cl.[7] ..... F22M 37/04
(52) U.S. Cl. ..... 123/446; 123/514
(58) Field of Search ..... 123/446, 447, 123/514, 516, 456, 179.17

(56) References Cited

U.S. PATENT DOCUMENTS 5,878,718 A 3/1999 Rembold et al.
6,058,912 A * 5/2000 Rembold ..... 123/516
6,135,090 A * 10/2000 Kawachi ..... 123/446
6,142,747 A * 11/2000 Rosenau ..... 123/446
6,234,151 B1 * 5/2001 Eck ..... 123/514
6,253,734 B1 * 7/2001 Rembold ..... 123/446
6,367,454 B1 * 4/2002 Rembold ..... 123/179.17
6,615,807 B2 * 9/2003 Rembold ..... 123/516

FOREIGN PATENT DOCUMENTS

DE 195 39 885 A1 11/1996
DE 198 18 421 A1 10/1999
EP 0 837 239 B1 2/2002

* cited by examiner

*Primary Examiner*—Carl S. Miller
(74) *Attorney, Agent, or Firm*—Michael J. Striker

(57) ABSTRACT

The fuel supply apparatus for supplying fuel to an internal combustion engine has a fuel tank (2), a first fuel pump (6) that supplies fuel from the fuel tank to a fuel line (10), a second fuel pump (12) that supplies fuel from the fuel line (10) via a pressurized line to at least one fuel valve (16) and a fuel return line (22) that connects the fuel line (10) to the fuel tank for return of excess fuel. A shut off valve (30), which is closed at high temperatures, and a pressure regulator valve (26) are arranged hydraulically in series in the fuel return line (22). A fuel scavenger line (60) is provided, by which fuel at high temperatures is returned to the fuel tank (2). The fuel scavenger line (60) conducts the fuel back to the fuel tank (2), at least partially through the second fuel pump (12) and through a hydraulic resistance. Gas bubble formation is prevented by a high fuel supply pressure and by transfer of heat from the second fuel pump (12).

25 Claims, 12 Drawing Sheets

FUEL SUPPLY APPARATUS FOR AN INTERNAL COMBUSTION ENGINE

BACKGROUND OF THE INVENTION

1. Field of the Invention

The present invention relates to a fuel supply apparatus for an internal combustion engine and, more particularly, to a fuel supply apparatus for supplying fuel to an internal combustion engine, comprising a fuel tank, a first fuel pump that supplies fuel from the fuel tank to a fuel line, a second fuel pump that supplies fuel from the fuel line via a pressurized line to at least one fuel valve that supplies fuel to the internal combustion engine at least indirectly and a fuel return line including a pressure regulator valve that connects the fuel line to the fuel tank.

2. Description of the Related Art

A fuel supply apparatus that supplies fuel by means of a first fuel pump from a fuel tank over a fuel line to a second fuel pump is known. The second fuel pump, for its part, supplies the fuel over a pressurized line to at least one fuel valve. Usually the number of the fuel valves is the same as the number of the cylinders in the internal combustion engine. The fuel supply apparatus can be constructed so that the fuel valves inject the fuel directly into the combustion chambers of the internal combustion engine. In operation of this fuel supply apparatus a higher pressure is required in the pressurized line leading to the fuel valves. After turning off the internal combustion engine it is desirable to mostly or entirely relieve the pressure in the fuel line and in the pressurized line to the internal combustion apparatus for safety reasons and because the fuel valves do not close entirely tightly.

The German disclosure document, DE 195 39 885 A1, describes a fuel supply apparatus, in which a valve device is provided for starting the internal combustion engine, so that the first fuel pump supplies the fuel with a high supply pressure to the fuel valves during the starting process. In many cases this high supply pressure is sufficient to start the internal combustion engine in the shortest possible time. Gas bubbles can be largely compressed in many cases between the first fuel pump and the second fuel pump by the elevated supply pressure so that a reliable operation of the internal combustion engine is guaranteed. In spite of that during the operation of the internal combustion engine at high temperatures and especially when the internal combustion engine is shut off at high temperatures, problems in both starting again and operation of the internal combustion engine occur at high temperatures. As has currently been established and described therein the gas bubbles of course are largely compressed at high pressure, however they are not sufficiently removed from the fuel supply apparatus. Furthermore it has currently been established that problems can occur at higher operating temperatures of the internal combustion engine because of the insufficient heat transfer from the fuel supply apparatus.

SUMMARY OF THE INVENTION

It is an object of the present invention to provide a fuel supply apparatus of the above-described kind that does not suffer from the above-described disadvantage.

This object and others, which will be made more apparent hereinafter, are attained in a fuel supply apparatus for supplying fuel to an internal combustion engine, comprising a fuel tank, a first fuel pump that supplies fuel from the fuel tank to a fuel line, a second fuel pump that supplies fuel from the fuel line via a pressurized line to at least one fuel valve so that the fuel at least indirectly reaches the internal combustion engine and a fuel return line including a pressure regulator valve that conducts fuel back from the fuel line to the fuel tank.

According to the invention a shut off valve is provided in the fuel return line hydraulically in series with the pressure regulator valve and a fuel scavenger line is provided that conducts the fuel back to the fuel tank, at least partially through the second fuel pump and through a hydraulic resistance.

Especially when there is a high thermal load on the fuel in the fuel supply apparatus, particularly when the second fuel pump is hot, also when the fuel is hot, the fuel supply apparatus according to the invention provides sufficient heat transfer from the fuel line so that no gas bubbles are generated in it. Fuel can be fed back to the fuel tank because of the scavenger line, which facilitates the advantageous heat transfer. Because of the closable shut off valve, fuel is returned over the scavenger line at high pressure in the fuel line between both fuel pumps, so that effective scavenging is guaranteed. Furthermore it is guaranteed that no gas bubbles or vapor bubbles occur at the inlet to the second fuel pump. Because of that feature a power loss, especially in the second fuel pump, and particularly at higher temperatures is reliably prevented. Reliable starting of the internal combustion engine is also guaranteed, especially at the higher temperatures.

Advantageous further embodiments of the invention are described and claimed in the appended dependent claims.

BRIEF DESCRIPTION OF THE DRAWING

The objects, features and advantages of the invention will now be illustrated in more detail with the aid of the following description of the preferred embodiments, with reference to the accompanying figures in which.

DESCRIPTION OF THE PREFERRED EMBODIMENTS

The fuel supply apparatus according to the invention can be used for metering fuel to an internal combustion engine for various different types of internal combustion engines. It can be used with different methods of operation of an internal combustion engine. The internal combustion engine, for example, can be an Otto motor with fuel injection or with a carburetor and spark ignition. The engine can be provided with reciprocating pistons (reciprocating engine) or with a rotary piston (Wankel engine). The internal combustion engine can also be a hybrid motor. In this latter engine with stratified charge the fuel-air mixture is sufficiently enriched in the vicinity of the spark plug so that combustion occurs in an average mixture, but also in a strongly lean mixture, and reliable ignition is guaranteed.

Gas exchange to and from the combustion chambers or breathing of the internal combustion engine can occur, for example, according to a four-stroke or two-stroke method. Gas exchange valves (inlet valves and outlet valves) can be provided in a known manner to control the gas exchange or breathing of the internal combustion engine. The internal combustion engine can be constructed so that one or more fuel valves directly inject fuel into the combustion chamber or chambers of the internal combustion engine. The control of the power of the internal combustion engine preferably occurs by control of the rate of supply of fuel to the combustion chambers. The fuel valve or valves can also introduce the fuel to an inlet valve or valves of the combustion chamber. In this embodiment the air for combustion of the fuel is usually supplied to the combustion chamber via a throttle. The position of this throttle controls the power delivered by the engine.

The internal combustion engine, for example, has a cylinder with a piston, or it can be provided with several cylinders and with a corresponding number of pistons. A fuel injection valve is preferably provided for each cylinder.

So that the scope or extent of the disclosure is not unnecessarily wide, the following description of the preferred embodiments is limited to reciprocating engines with four cylinders, in which four fuel valves directly inject the fuel, usually gasoline, into the combustion chambers of the internal combustion engine. The fuel injection rate controls the power of the internal combustion engine. Charge stratification with fuel enrichment in the vicinity of the spark plug occurs during idle and lower loads. Outside of this range the mixture is very lean. During full load or higher loads uniform distribution between fuel and air in the combustion chambers is desired.

Figure 1:
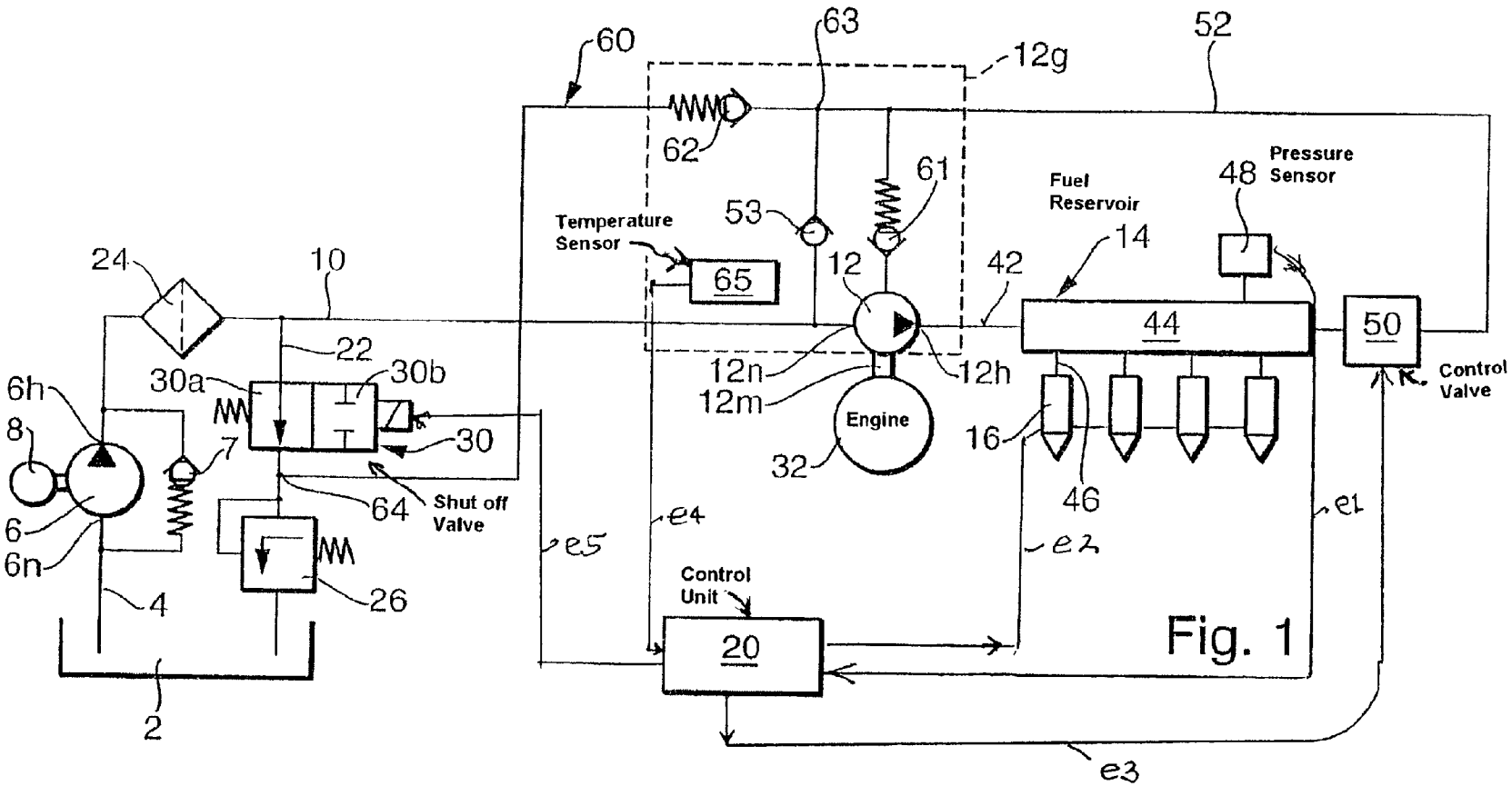
FIG. 1 is a schematic diagram of a first embodiment of a fuel supply apparatus according to the invention.

FIG. 1 shows a fuel tank 2, a vacuum line 4, a first fuel pump 6, an overpressure valve 7, an electric motor 8, a fuel line 10, a second fuel pump 12, pressurized line 14, four fuel valves 16 and a control unit 20. The fuel valves 16 are often designated in professional circles as injector valves or injectors and are controlled by electrical control signals transmitted from the control unit 20 over electrical line e2.

The first fuel pump 6 has a pressurized side 6*h* and a drawing or vacuum side 6*n*. The second fuel pump 12 has a high pressure side 12*h* and a low pressure side 12*n*. The fuel line 10 leads from the pressurized side 6*h* of the first fuel pump 6 to the low pressure side 12*n* of the second fuel pump 12. A return channel leads back to the fuel tank 2 from the high pressure side 6*h* of the first fuel pump 6.

A fuel return line 22 branches from the fuel line 10. Fuel from the fuel line 10 can be conducted back into the fuel tank 2 by means of the fuel return line 22. A filter 24 is arranged in the fuel line 10, between the first fuel pump 6 and the second fuel pump 12.

A pressure regulator valve 26 and a shut off valve 30 are provided in the fuel return line 22. The pressure regulator valve 26 and the shut off valve 30 are connected to act one after the other. That means that the pressure regulator valve 26 and the shut off valve 30 are connected in series with each other. The pressure regulator valve 26 and the valve device 30 can also be compactly embodied together in a common housing.

The shut off valve 30 has a first position 30*a* and a second position 30*b*. In the first position 30*a* fuel can flow from the fuel line 10 through the fuel return line 22 through the pressure regulator valve 26 into the fuel tank 2. In this position the pressure regulator valve 26 directly determines the supply pressure of the fuel in the fuel line 10. If the shut off valve 30 is in its second position 30*b*, fuel cannot flow directly from the fuel line 10 to the pressure regulator valve 26.

The first fuel pump 6 is driven by an electric motor 8. The first fuel pump 6, overpressure valve 7, electric motor 8, filter 24, pressure regulator valve 26 and shut off valve 30 are arranged in or near the fuel tank 2. These parts are preferably arranged on the fuel tank 2 outside of it or within the fuel tank 2.

The second fuel pump 12 is mechanically coupled with a drive shaft of symbolically indicated motor 32 by means of a mechanical transmitting means 12*m*. The camshaft of the internal combustion engine 32 functions as the drive shaft. Since the second fuel pump 12 is mechanically coupled to the drive shaft of the internal combustion engine, the second fuel pump operates according to the rotation speed of the drive shaft of the internal combustion engine 32. Because the second fuel pump 12 is flanged closely to the housing of the internal combustion engine 32, considerable heat is transferred from the internal combustion engine 32 to the second fuel pump 12, which causes a comparatively great heat load on the fuel in the fuel tank 2.

The pressurized line 14 leading from the second fuel pump 12 to the fuel valves 16 can for simplicity be divided into an entrance section 42, a reservoir 44 and a plurality of distributor lines 46. The respective fuel valves 16 are connected to the reservoir 44 by corresponding distributor lines 46. The pressure sensor 48 is connected to the reservoir 44 and senses the pressure of the fuel in the pressurized line 14. The pressure sensor 48 transmits an electrical sensor signal dependent on the magnitude of this pressure to the control unit 20 over electrical conductor e1.

A control valve 50, which is controlled electrically by the control unit 20 via electrical line e2, is connected to the reservoir 44 of the pressurized line 14. Fuel is conducted from the pressurized line 14 to the low pressure side 12*n* of the second fuel pump 12 by means of circulator line 52. A hydraulic resistance element is arranged between the control valve 50 and the low pressure side 12*n*. The resistance element is a check valve 53, which opens only in the direction to the fuel line 10 under a very low pressure difference.

The first fuel pump 6, for example, can be a positive-displacement fuel pump driven by an electric motor 8, which feeds a predetermined amount of fuel for each revolution. The pressure of the fuel on the high pressure side 6*h* of the first fuel pump 6 is subsequently designated as the supply pressure. The supply pressure in the fuel line 10 is determined by the pressure regulator valve 26 when the shut off valve is opened. The pressure regulator valve 26 is set, for example, at a pressure difference of 3 bar. Also the supply pressure in the fuel line 10 amounts to three bar (3 bar) when the shut off valve 30 is open.

Figure 4:
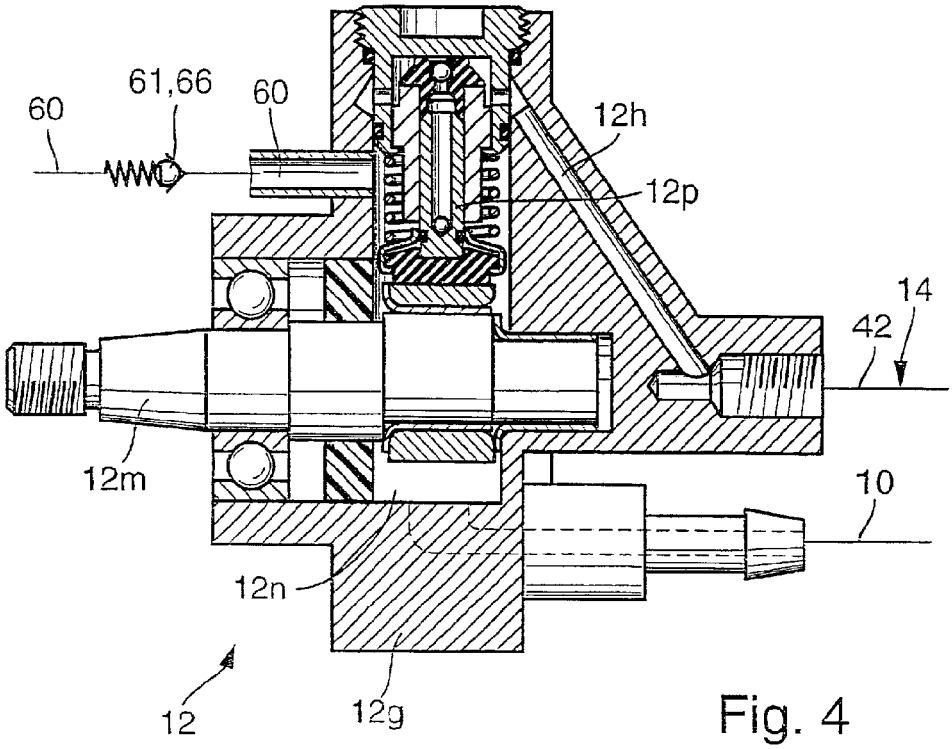
FIG. 4 is a cross-sectional view through a second fuel pump according to the invention.

A scavenger line 60 leads from the second fuel pump 12 to the fuel tank 2. The scavenger line 60 is connected with the low pressure side 12*n* of the second fuel pump 12 within the pump housing 12*g*, as shown in FIG. 4. The hydraulic resistance is formed by a first overflow valve 61 and a second overflow valve 62. Branch point 63 is located in the circulator line 52. The scavenger line 60 branches from the branch point 63. In the advantageous embodiment shown in FIG. 1 the scavenger line 60 opens into an opening 64 between the shut off valve 30 and the pressure regulator valve 26 in the fuel return line 22. The first overflow valve 61 is adjusted to a comparatively low pressure difference, preferably 1 bar. Also the second overflow valve 62 is adjusted to a comparatively low pressure difference, preferably at 1 bar. Because the pressure differences of both overflow valves 61, 62 can be adjusted to comparatively low values, a comparatively simple structure can be selected for the overflow valves, without large leakage resulting at the set pressure difference.

The first fuel pump 6 generally supplies somewhat more fuel to the fuel line 10 than is taken from the fuel line 10 by the second fuel pump 12. In normal operation the excess fuel flows through the normally open shut off valve 30 and through the pressure regulator valve 26, so that the supply pressure in the fuel line 10 adjusts itself based on the pressure difference in the pressure regulator valve 26.

When temperature sensor 65 establishes that an especially high temperature has been reached, an appropriate signal is supplied to the control unit 20 over conductor e4. The control unit 20 then switches the shut off valve 30 to its second position 30*b* via electrical line e5, so that the direct connection of the fuel line 10 to the pressure regulator valve 26 is interrupted. With the shut off valve 30 closed, the excess fuel not taken from the fuel line 10 by the second fuel pump 12 flows through the pump housing 12*g* of the second fuel pump 12, by the first fuel overflow valve 61, through the second overflow valve 62 and through the pressure regulator valve 26 back into the fuel tank 2. Because of that a supply pressure, which corresponds to the sum of the pressure differences of the valves 61, 62 and 26, results. The overpressure valve 7, for example, is adjusted to a pressure, which is higher than the sum of the pressure differences at the valves 61, 62 and 26 in the selected embodiment.

Because the scavenger line 60 leads through the pump housing 12*g* of the second fuel pump 12, heat energy from the second fuel pump 12 can be conducted away by the fuel flowing through the scavenger line 60, whereby an excessive temperature of the fuel in the region of the fuel line 10 and in the region of the second fuel pump 12 is avoided. Because of that feature it is guaranteed that the supply pressure in the fuel line 10 with the shut off valve 30 closed is higher than the supply pressure during normal operating conditions of the internal combustion engine 32, so that a non-standard high temperature does not lead to gas bubbles in the fuel line 10, whereby no decrease in efficiency of the second fuel pump 12 need be feared even at higher heat load. Because the increased supply pressure is set only at comparatively high temperature, also usually only for a comparatively short time interval, no noteworthy shortening of the service life of the comparatively economically manufactured first fuel pump 6 results.

Because the excess fuel quantity supplied by the second fuel pump 12 in the pressurized line 14, which is not injected by the fuel valves 16, passes through the control valve 50 from the reservoir 44, over the circulator line 52 through the check valve 53 directly to the low pressure side 12*n* of the second fuel pump 12, unnecessary routes for the circulation of the fuel are avoided and no heated fuel is guided back to the fuel tank 2 from the pressurized line 14 in normal operating conditions of the internal combustion engine, so that unnecessary heating of the fuel in the fuel tank 2 is avoided during normal operating conditions of the engine.

The fuel pump 12 has a pump housing 12*g* shown in the drawing with dashed lines. The overflow valves 61, 62, check valve 53, branch point 63 and the sensor 65 are preferably contained within the pump housing 12*g*.

The sensor 65 is, for example, a temperature gauge and it can, for example, be arranged directly in the pump housing 12*g* or in the vicinity of the pressurized line 14. Instead of the sensor 65, for example, also the water temperature of the cooling water of the internal combustion engine 32 can be ascertained to measure the temperature.

Figure 2:
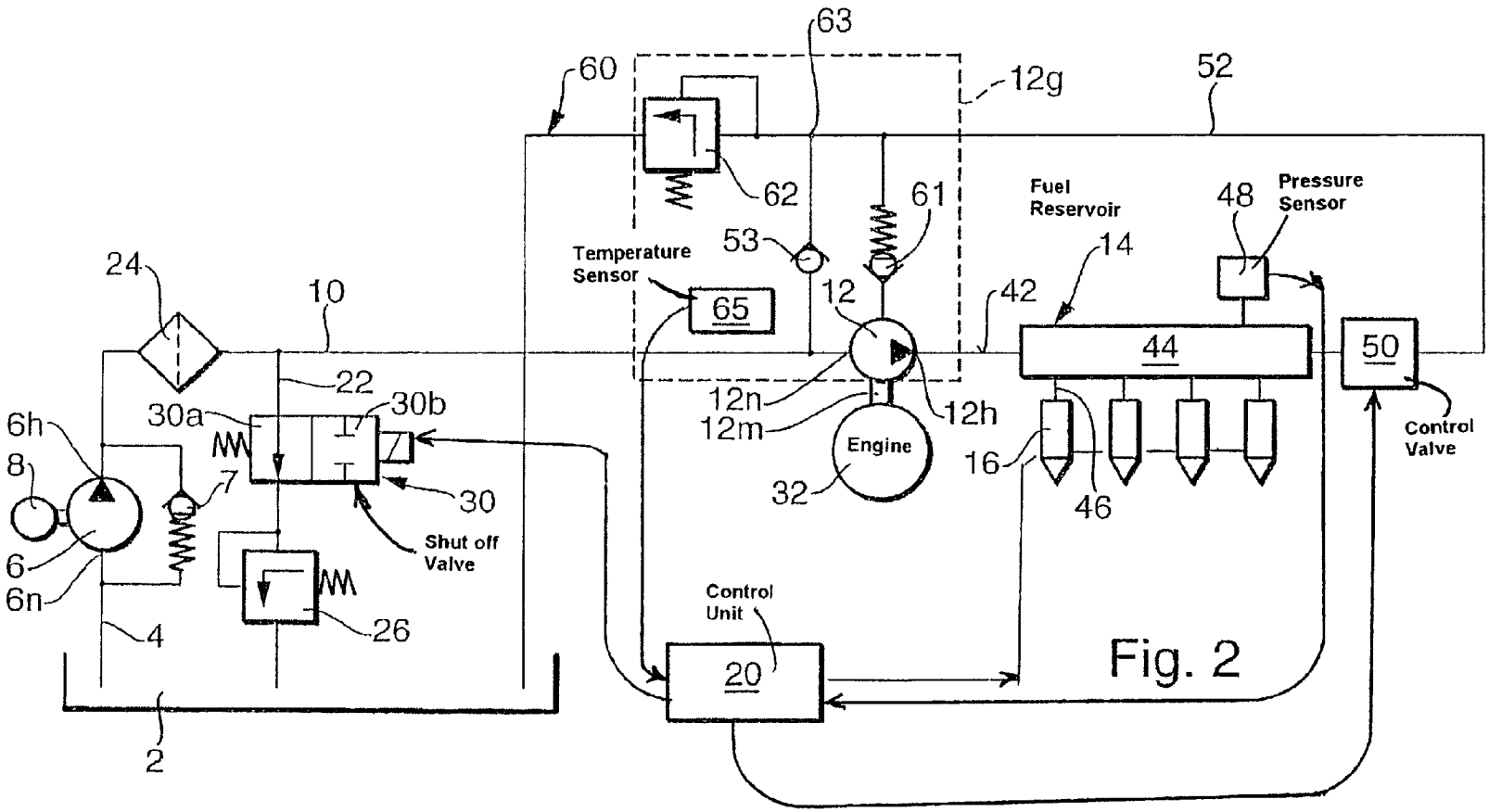
FIG. 2 is a schematic diagram of a second embodiment of a fuel supply apparatus according to the invention.

FIG. 2 shows an additional preferred embodiment of the fuel supply apparatus according to the invention.

In all figures for the following described embodiments the same, or similarly acting, parts are designated with the same reference characters. In so far as nothing to the contrary is mentioned and/or shown in the figures in regard to features shown and described in one of the figures, the same goes for the other embodiments shown in the other figures. In so far as nothing is said regarding a change in the description, the individual features of the separate embodiments are combinable with each other.

The scavenger line 60 in the embodiment shown in FIG. 2 differs from the corresponding scavenger line 60 in the embodiment of FIG. 1. The scavenger line 60 in the embodiment of FIG. 2 leads directly from the second overflow valve 62 to the fuel tank 2. In order to obtain a uniformly high feed pressure with shut-off valve 30 closed, as explained with the aid of FIG. 1, the pressure difference of the second overflow valve 62 is not set at 1 bar as in the first embodiment, but instead is set for example at 5 bar.

An intervening section of the scavenger line 60 between the first overflow valve 61 and the second overflow valve 62 is combined with an intervening section of the circulator line 52 between the control valve 50 and the check valve 53 in the embodiments shown in FIGS. 1 and 2. Because of this feature of this embodiment an effective scavenging of both the fuel line 10 and the housing 12*g* of the second fuel valve 12 takes place. The circulator line 52 thus provides both scavenging and heat transfer.

Figure 3:
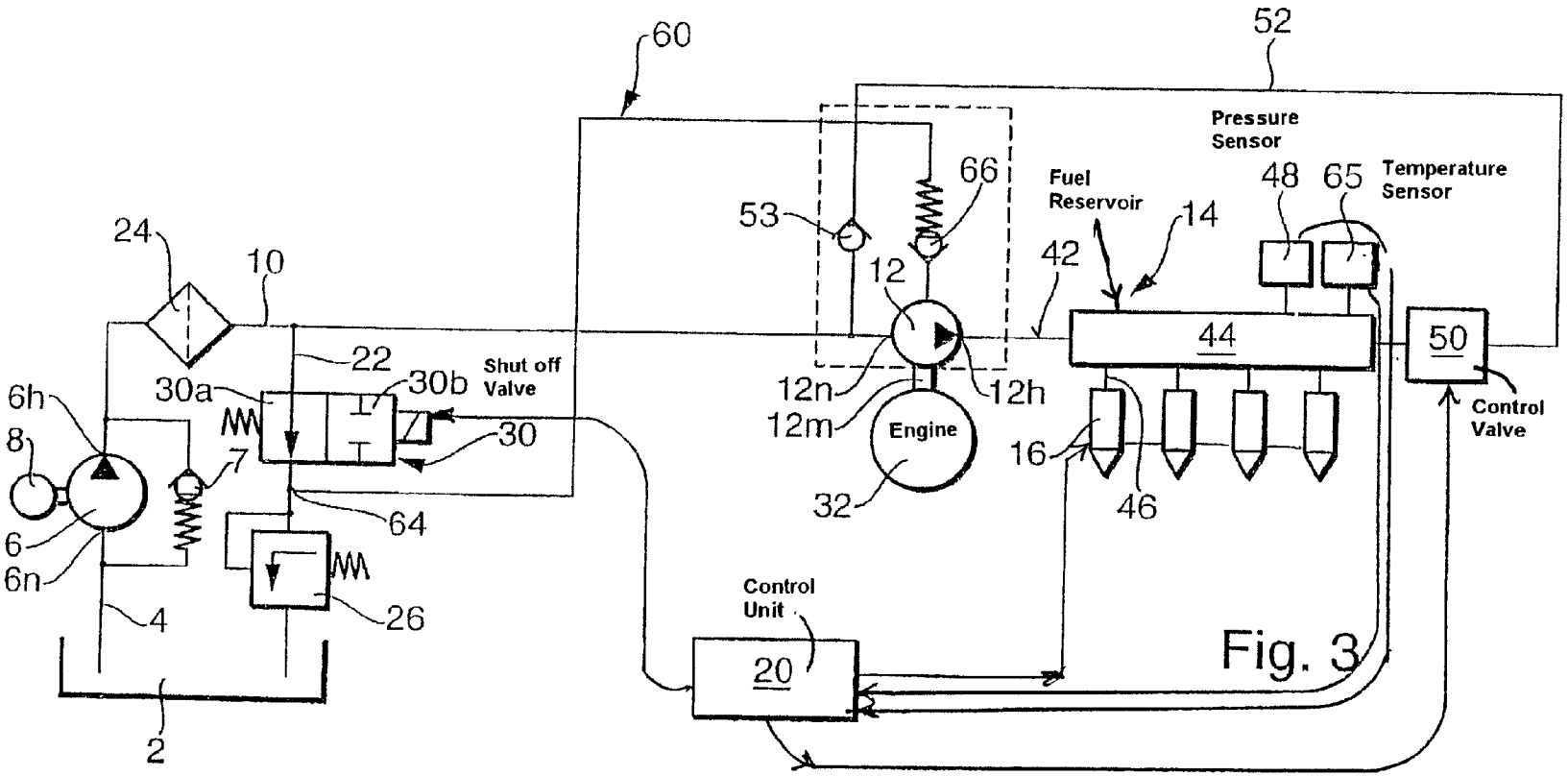
FIG. 3 is a schematic diagram of a third embodiment of a fuel supply apparatus according to the invention.

FIG. 3 shows an additional particularly advantageous preferred embodiment of the fuel supply apparatus according to the invention.

The fuel from the low pressure side 12*n* of the second fuel supply pump 12 reaches the fuel tank 2 through the scavenger line 60 and the pressure regulator valve 26 via an overflow valve 66 in the embodiment shown in FIG. 3. The overflow valve 66 provides hydraulic resistance in the scavenger line 60.

In contrast to the embodiment shown in FIGS. 1 and 2 the scavenger line 60 downstream of the overflow valve 66 is not combined with or connected to the circulator line 52. The advantage that fewer valves are required is attained because of that feature. In spite of that at last one indirect evacuation of the circulator line 52 is possible by means of the check valve 53, the low pressure side 12*n* of the second fuel pump 12 and the scavenger line 60 with the overflow valve 66 in the embodiment shown in FIG. 3.

In order to obtain the same pressure conditions in the embodiment shown in FIG. 3 as in the embodiments shown in FIGS. 1 and 2, the pressure difference of the overflow valve 66, for example, is set to 2 bar.

In principle the overflow valve 7 can be eliminated in the embodiments shown in FIGS. 1 to 3. However the overflow valve 7 is recommended in these embodiments as a protection against the eventual clogging of the filter 24.

FIG. 4 is a cross-sectional view of the second fuel pump 12.

The fuel pump 12 has at least one pump plunger 12*p*. Preferably the fuel pump 12 has three pump plungers, but only one is shown for simplicity in FIG. 4. Fuel reaches the interior of the pump housing 12*g* via the fuel line 10. The low pressure 12*n* and the at least one pump plunger 12*p* are located within the pump housing 12*g*. The pump plunger 12*p* is surrounded by fuel, which has the same supply pressure as in the fuel line 10. The scavenger line 60 branches from the highest point of the interior of the housing 12*g* of the fuel pump 12. The air collecting at the highest point in the pump housing 12*g* is conducted through the scavenger line 60 to the fuel tank 2 because of the location of the connection of the scavenger line to the housing 12*g*.

Figure 5:
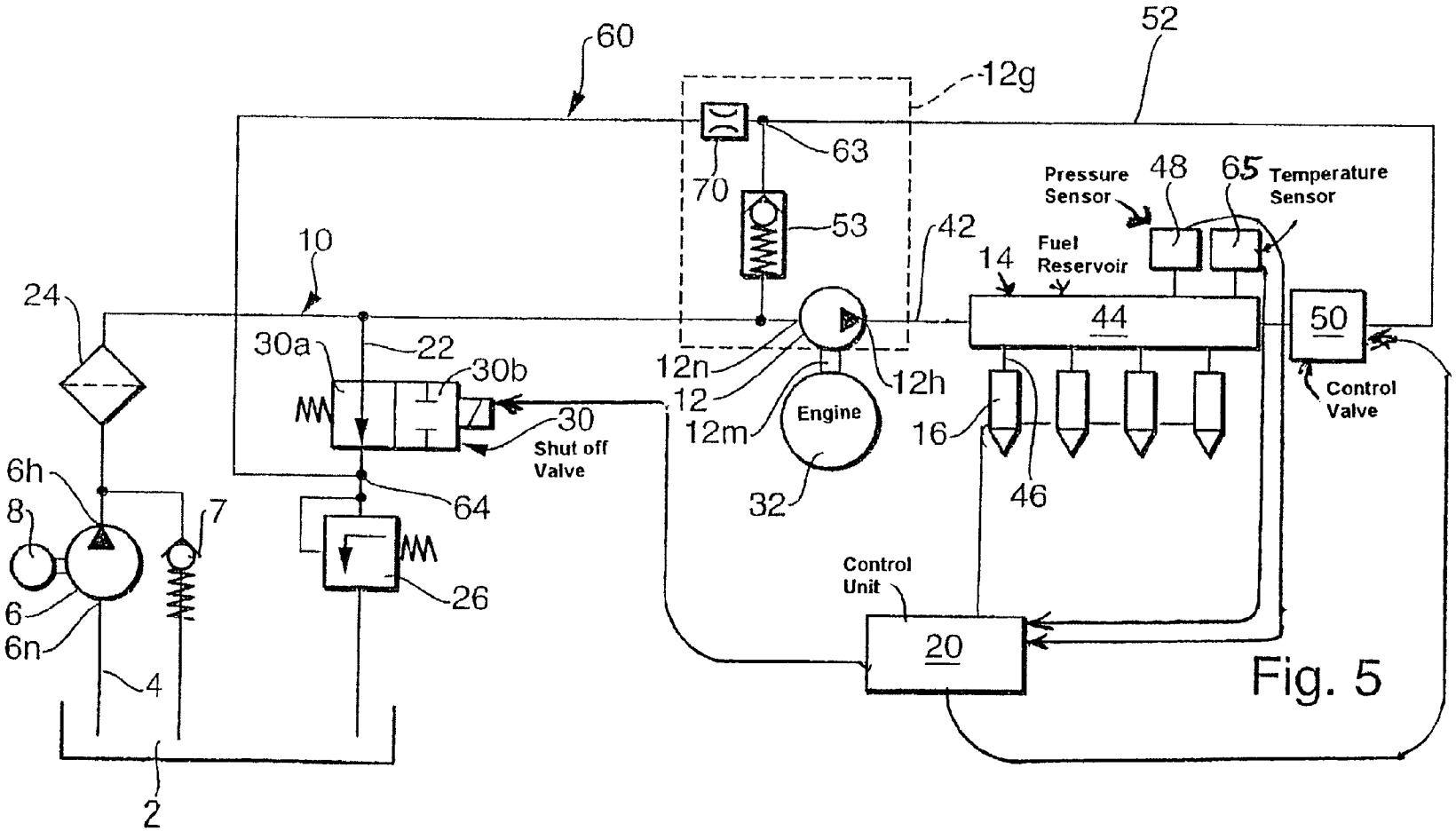
FIG. 5 is a schematic diagram of a fourth embodiment of a fuel supply apparatus according to the invention.

FIG. 5 shows an additional particularly advantageous preferred embodiment of the fuel supply apparatus according to the invention.

A channel leading to the fuel tank 2 branches from the high pressure side 6*h* of the fuel pump 6 immediately downstream behind the first fuel pump 6. The overflow valve 7 is arranged in this channel. The overflow valve 7 is, for example, set to 8 bar. The overflow valve 7 is still however located before the filter 24 in the flow direction, in order to guarantee that clogging of the filter 24 does not lead to an excessive pressure in the first fuel pump 6.

The branch point 63, from which the scavenger line 60 branches from the circulator line 53, is located between the control valve 50 and the check valve 53. Hydraulic resistance is provided in the scavenger line 60. A throttle 70 provides the hydraulic resistance.

The check valve 53 has a compressed spring. The spring pressure of the check valve 53 is tuned to the flow resistance of the throttle 70. The spring pressure is determined so that, when the shut off valve 30 is in its open position, a desired fuel flow rate from the circulator line 52 through the scavenger line 60 and the pressure regulator valve 26 to the fuel tank 2 is continuously provided.

When the shut off valve 30 is in its closed position 30*b*, excess fuel supplied by the first fuel pump 6, but not delivered by the injector valves 16, flows through the overpressure valve 7 into the fuel tank 2. Also a part of the excess fuel flows through a throttle 70 and through the pressure regulator valve 26 to the fuel tank 2. The pressure at the overpressure valve 7 is thus set so that it is higher than the pressure difference at the pressure regulator valve 26 and the fuel flowing through the scavenger line 60 also accumulates at the throttle 70. Then with the shut off valve in its closed position the supply pressure in the fuel line 10 is clearly higher than the supply pressure occurring in normal operation with the shut off valve 30 in its open position. Gas bubbles occurring in the second fuel pump 12 and/or in the fuel line 10 are thus reliably compressed. A portion of the fuel is returned from the circulator line 52 to the fuel tank 2. An additional transfer of undesirable heat energy generated in the fuel supply apparatus is obtained because of that feature. The relative portions of fuel flowing directly from the circulator line 52 to the low pressure side 12*n* of the second fuel pump 12 and flowing through the scavenger line 60 back to the fuel tank 12 can be controlled or adjusted by controlling the compression pressure of the spring in the check valve 53.

In the embodiment shown in FIG. 5 the throttle 70 provides that a certain portion of fuel, which can be selected according to the pre-compression of the spring in the check valve 53, is also fed back from the circulator line 52 to the fuel tank 2 under normal operating conditions.

Figure 6:
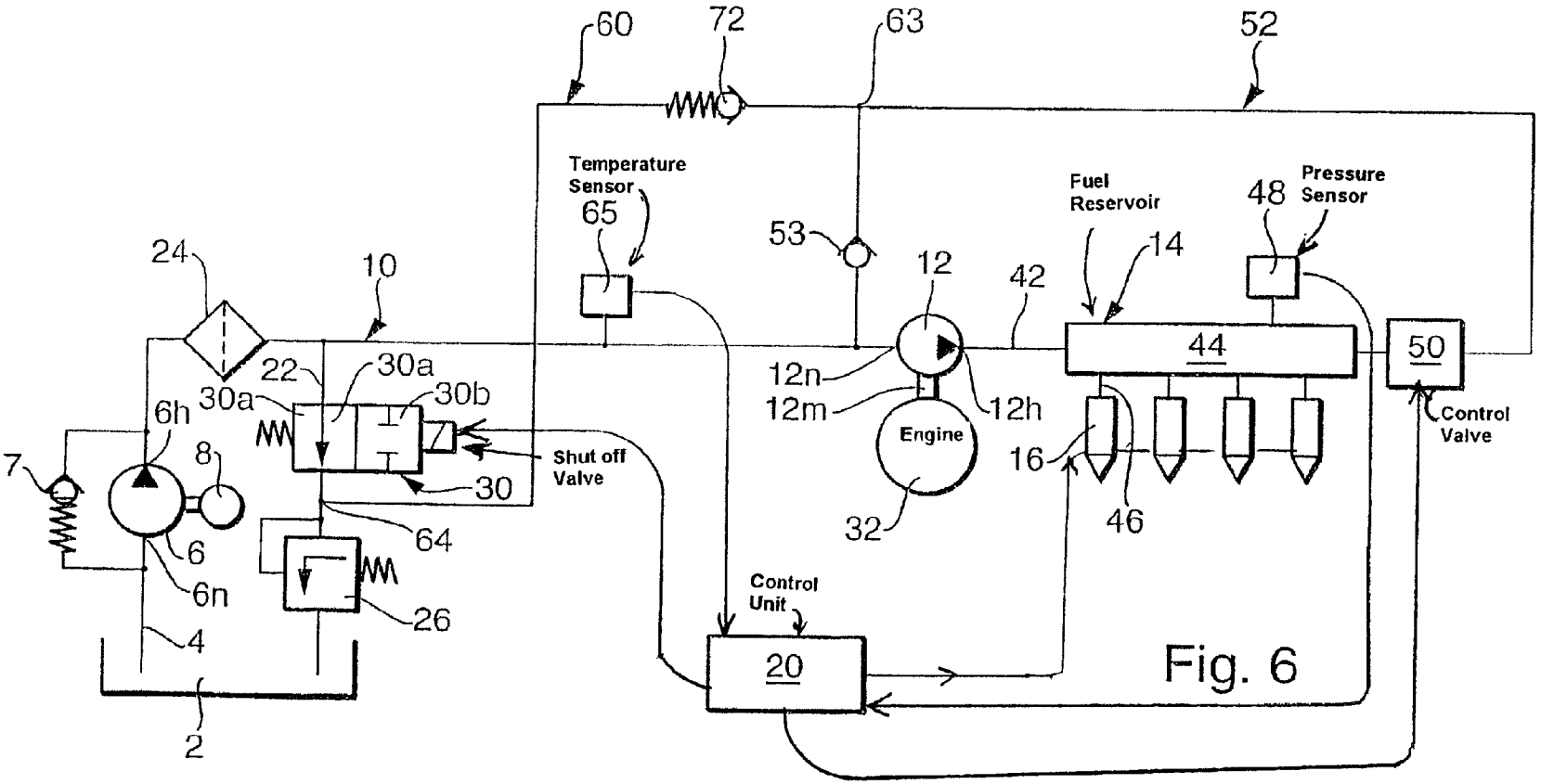
FIG. 6 is a schematic diagram of a fifth embodiment of a fuel supply apparatus according to the invention.

FIG. 6 shows an additional particularly advantageous preferred embodiment of the fuel supply apparatus according to the invention.

Deviating from the embodiment of FIG. 5 the hydraulic resistance in the scavenger line 60 is provided by an overflow valve 72 arranged in the scavenger line 60. The overflow valve 72 is set so that it opens when the pressure difference of 2 bar is reached. The check valve 53 is set so that it opens at a very low pressure difference. Because of these features in normal operation of the fuel supply unit, which means, when the shut off valve 30 is in its open position 30*a*, the supply pressure in the fuel line 10 is determined by the pressure regulator valve 26. Then the fuel supplied by the second fuel pump 12 and not delivered by the fuel valves 16 flows a short way from the high pressure side 12 via the control valve 50, through the circulator line 52 and through the check valve 53 to the low pressure side 12*n* of the second fuel pump 12. The pre-tensioned overflow valve 72 provides that no fuel flows back from the circulator line 52 to the fuel tank 2. Because of these features in normal operation of the fuel supply apparatus the temperature of the fuel in the fuel tank 2 is kept as low as possible.

In order to return fuel the shut off valve 30 is set in its closed position 30*b*. The supply pressure in the fuel line 10 then climbs until it exceeds the pressure at the overflow valve 7 and the predetermined pressure limit of the overflow valve 72 so that fuel flows from the circulator valve 52, through the overflow valve 72 and through the pressure regulator 26 and into the fuel tank 2.

Figure 7:
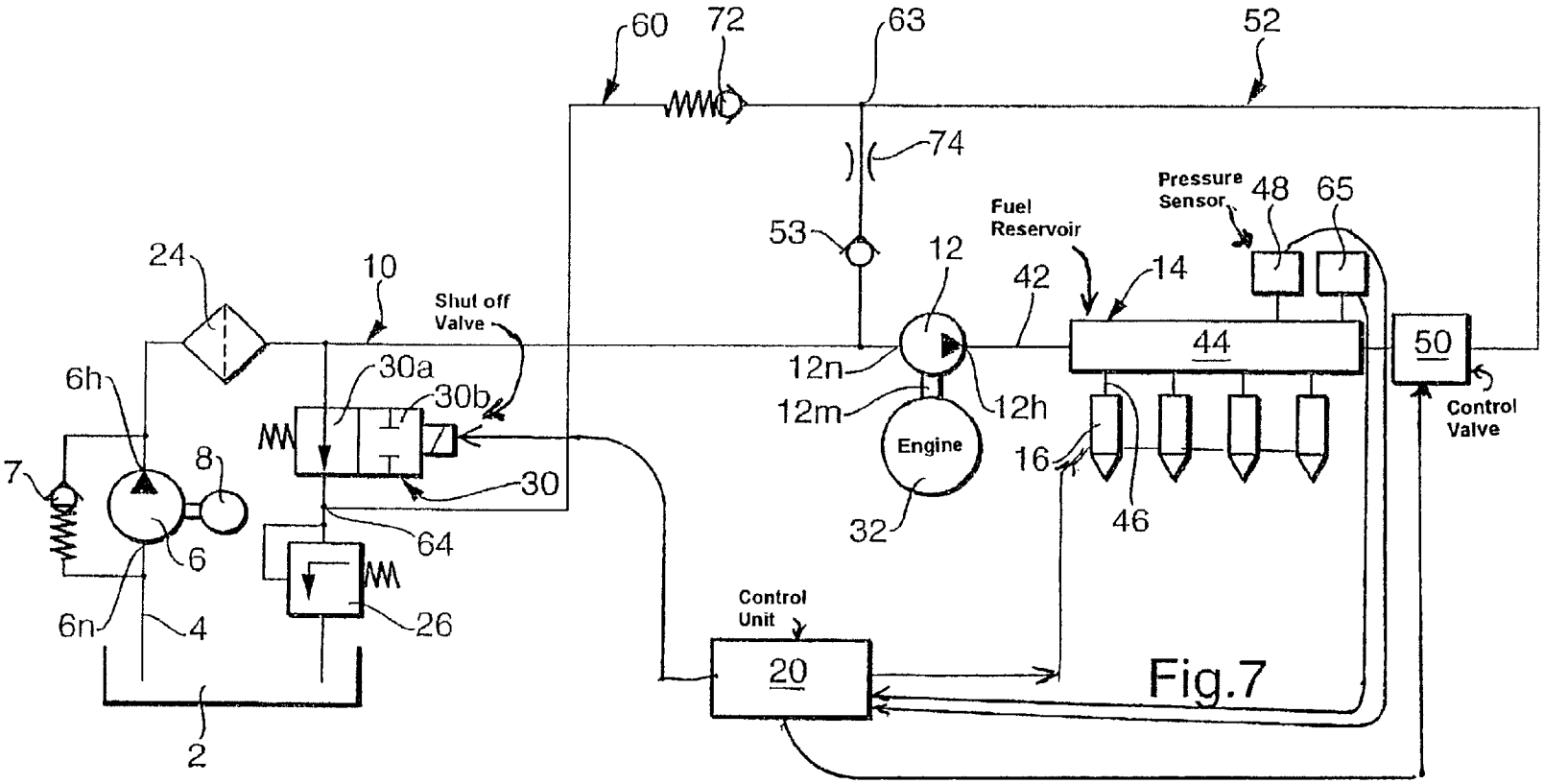
FIG. 7 is a schematic diagram of a sixth embodiment of a fuel supply apparatus according to the invention.

FIG. 7 shows an additional particularly advantageous preferred embodiment of the fuel supply apparatus according to the invention.

An additional hydraulic resistance element is provided in the circulator line 52 in the embodiment symbolically represented in FIG. 7, which is not present in the embodiment shown in FIG. 6. The additional hydraulic resistance element is a throttle 74. The throttle 74 is arranged hydraulically in series with the check valve 53. The throttle 74 can be considered as being either downstream or upstream of the check valve 53. The throttle 74 and the check valve 53 are located downstream of the branch point 63 to the scavenger line 60.

When a comparatively large amount of fuel is pumped into the circulator line 52 at higher rotation speeds of the internal combustion engine 32, a back up pressure develops before the throttle 74 and, when this backup pressure is large enough to overcome the pre-tensioned overflow valve 72, at least one portion of the fuel pumped by the second fuel pump 12 flows back into the fuel tank 2. This is one purpose of the throttle 74.

The embodiment shown in FIG. 7 can be adjusted so that a portion of the fuel from the circulator line 52 flows back into the fuel tank 2 at high rotation speed of the internal combustion engine 32. Otherwise a higher supply pressure must be provided in the fuel line 10 by switching the shut off valve 30 into its closed position 30*b*. This has the advantage that at higher rotation speeds of the engine 32, which inevitably and frequently occur during travel, the first fuel pump 6 need not be operated against high feed pressure, which increases the service life. In the embodiment according to FIG. 7 the shut off valve 30 must be shut off for only a short time interval, for example for return of fuel during the starting process of the internal combustion engine 32.

This means that the fuel pump 6 operates only rarely against a high supply pressure, which substantially extends the service life of the fuel pump 6.

Figure 8:
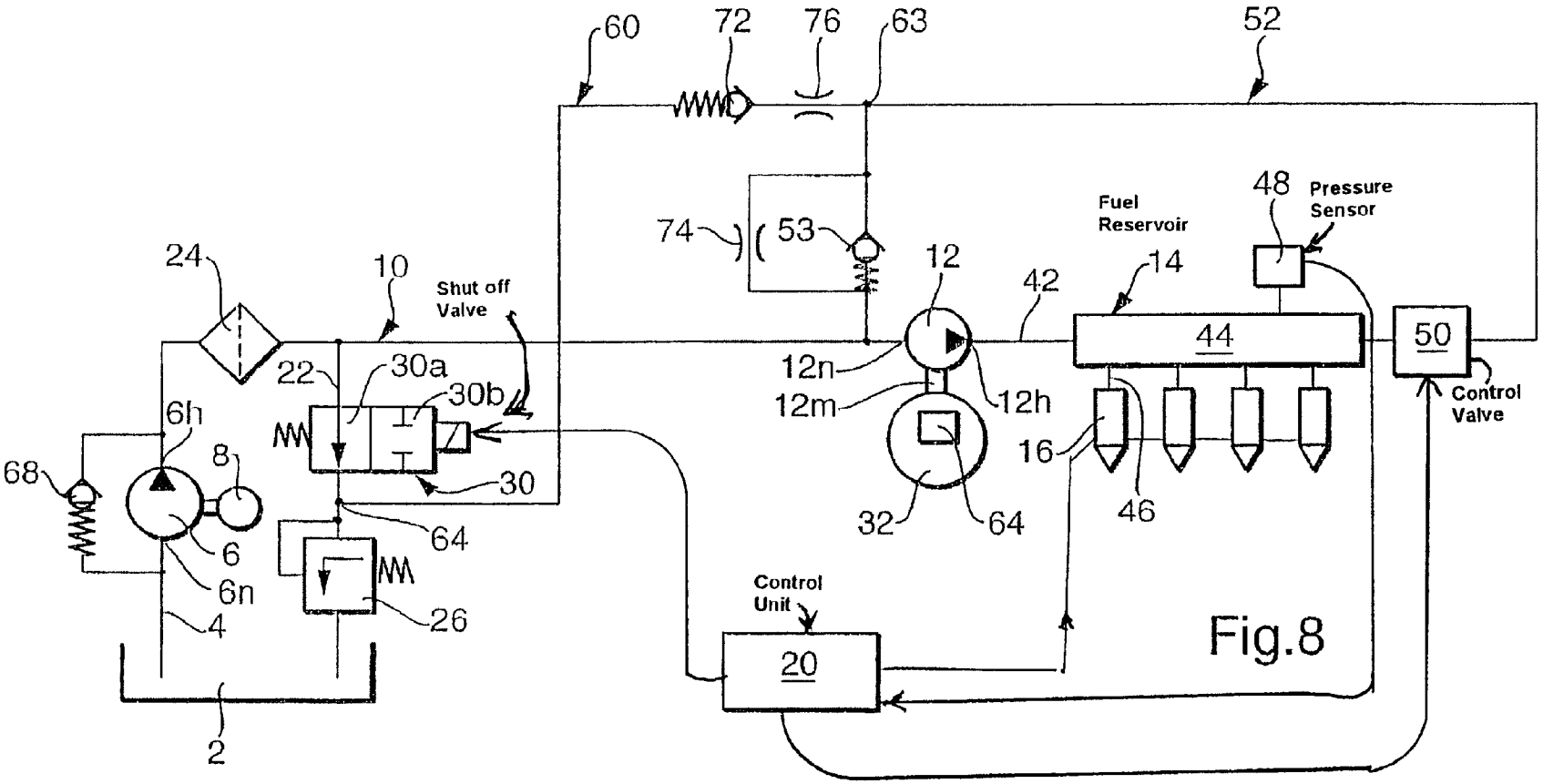
FIG. 8 is a schematic diagram of a seventh embodiment of a fuel supply apparatus according to the invention.

FIG. 8 shows an additional particularly advantageous preferred embodiment of the fuel supply apparatus according to the invention.

The throttle 74 and the check valve 53 are located hydraulically downstream of the branch point 63 in the circulator line 52, from which the scavenger line 60 branches in the embodiment shown in FIG. 8. The throttle 74 and the non-return valve 53 are hydraulically connected in parallel to each other. The check valve 53 is biased with a closing spring. The check valve 53 opens when a sufficiently large pressure difference is present at the throttle 74 for opening of the check valve. The check valve 53 also limits the pressure drop across the throttle 74.

An additional hydraulic resistance is provided in the scavenger line 60 hydraulically downstream of the branch point 63. The additional hydraulic resistance is provided by a throttle 76 provided in the scavenger line 60. The throttle 76 is hydraulically in series with the overflow valve 72 either upstream or downstream of it.

The proportion of fuel flowing through the scavenger line 60 to the fuel tank 2 and flowing through the circulator line 52 to the low pressure side 12*n* of the fuel pump 12 can be adjusted by tuning or adjustment of the throttles 74 and 76 and the pre-tension in the check valve 53 and the overflow valve 72. The rotation speed value at which a part of the fuel flowing through the circulator line 52 flows back to the fuel tank 2 via the scavenger line 60 can also be preset.

Figure 9:
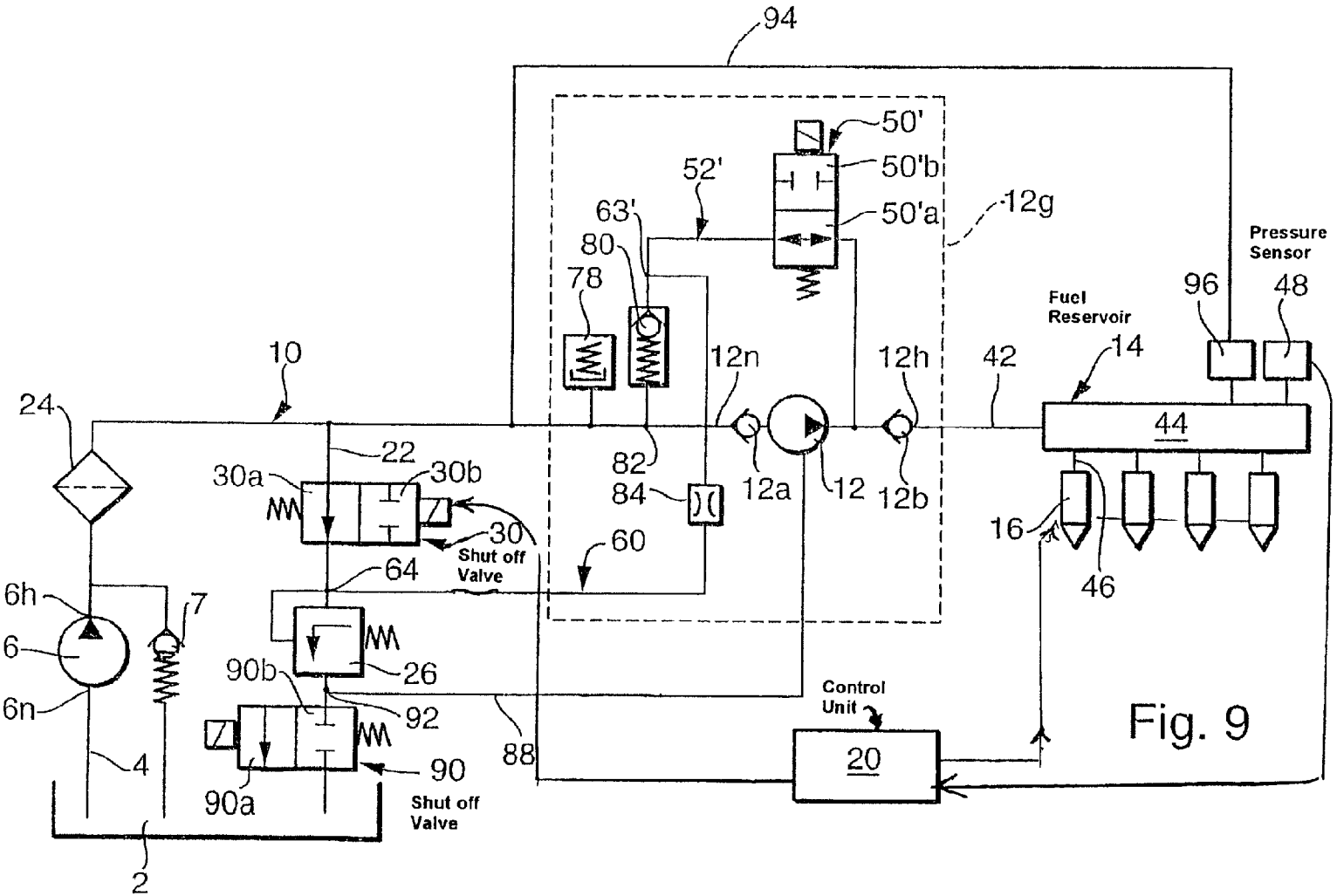
FIG. 9 is a schematic diagram of an eighth embodiment of a fuel supply apparatus according to the invention.

FIG. 9 shows an additional particularly advantageous preferred embodiment of the fuel supply apparatus according to the invention.

Figure 10:
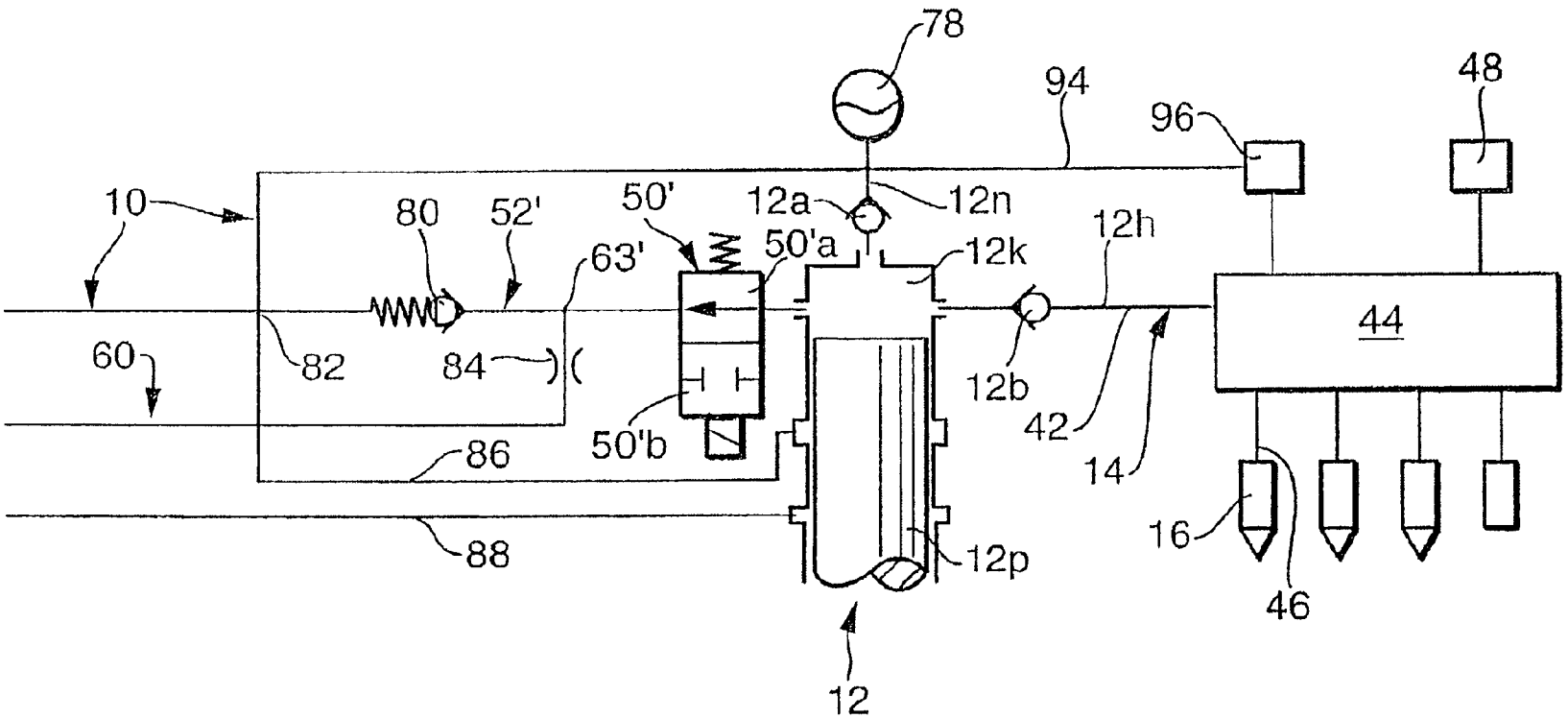
FIG. 10 is a detailed schematic diagram of a portion of a fuel supply apparatus according to the invention.
Figure 11:
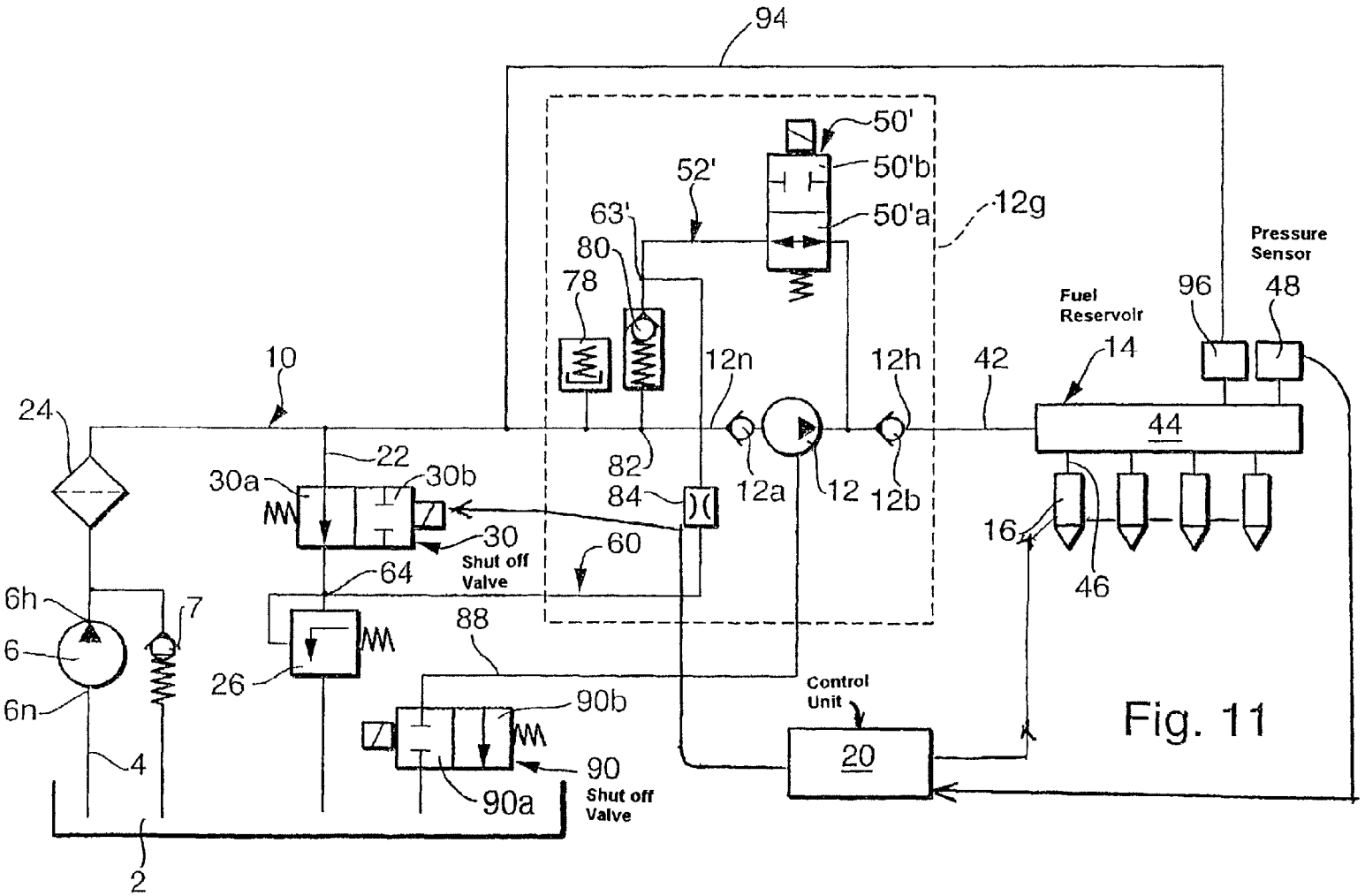
FIG. 11 is a schematic diagram of a ninth embodiment of a fuel supply apparatus according to the invention.
Figure 12:
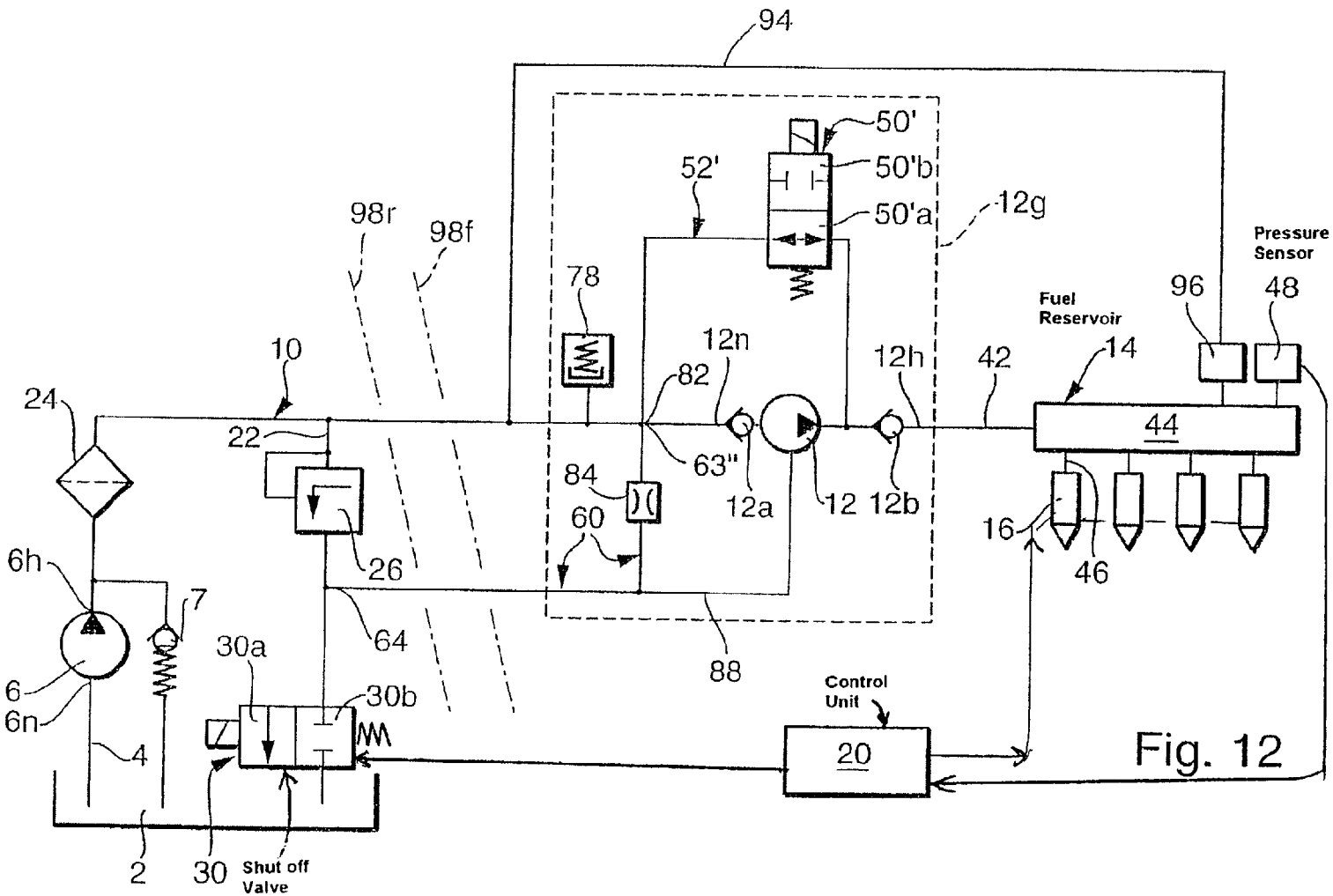
FIG. 12 is a schematic diagram of a tenth embodiment of a fuel supply apparatus according to the invention.

FIG. 10 is a detailed view of part of the embodiments of the fuel supply apparatus shown in FIGS. 9, 11 and 12.

In the embodiments shown in FIGS. 9 and 10 the second fuel pump 12 has a pump plunger 12*p*, an inlet side check valve 12*a*, an outlet-side check valve 12*b*, a compression chamber 12*k* and a control valve 50'.

A pressure damper 78 is connected to the fuel line 10. The pressure damper 78 is preferably located inside the pump housing 12*g*. A hydraulic resistance element is arranged in the circulator line 52'. The resistance element is a check valve 80, which opens in the direction of the fuel line 10. The circulator line 52' opens into the fuel line 10 at an opening 82. The circulator line 52' runs from the compression chamber 12*k*, through the control valve 50', by the branch point 63', through the check valve 80 and through the opening 82 into the fuel line 10. The circulator line 52' extends a short way directly inside the pump housing 12*g*. The control valve 50' has an open switch position 50'*a* and a closed position 50'*b*. The scavenger line 60 branches off at the branch point 63' between the control valve 50' and the check valve 80. The scavenger line 60 has a hydraulic resistance downstream of the branch point 63'. The hydraulic resistance is a throttle 84.

A connection line 86 leads from the fuel line 10 to the region of the compression chamber 12*k* in which the plunger 12*p* travels. The pressure transmitted over the connection line 86 provides a reduction of the friction in the region of the chamber 12*k* in which the plunger 12*p* travels.

A leakage or bleeder line 88 is connected to the region of the compression chamber 12*k* remote from the end of the pump plunger 12*p*. A second shut off valve 90 is arranged in the fuel return line 22 downstream of the pressure regulator valve 26. The second shut off valve 90 has an open position 90*a* and a closed position 90*b*. The leakage line 88 opens into the return line 22 between the pressure regulator valve 26 and the second shut off valve 90 at opening 92.

During a suction stroke, which means, during the downward travel of the pump plunger 12*p* so that the compression chamber 12*k* increases in size, the fuel flows from the fuel line 10 through the inlet side check valve 12*a* into the compression chamber 12*k*. During a compression stroke, which means, during the upward travel of the pump plunger 12*p* so that the compression chamber 12*k* decreases in size, the pump piston 12*p* forces the fuel from the compression chamber 12*k* through the outlet side check valve 12*b* into the reservoir 44 of the pressurized line 14, in so far as control valve 50' is in its closed position 50'*b*. It is possible to control the control valve 50' so that it is in the open position 50'*a* during a part of the compression stroke of the pump plunger 12*p*. While the control valve 50' stands in its open position 50'*a* during a portion of the compression stroke, the fuel is fed through the open control valve 50', through the circulator line 52' and through the check valve 80 into the fuel line 10, because of the normally high pressure in the fuel line 10. The throttle 84 and the pre-tensioned check valve 80 can be adjusted with respect to each other, so that, when the control valve 50' is open during the compression stroke, a part of the fuel flowing through the circulator line 52' flows back through the scavenger line 60 and through the pressure regulator valve 26 into the fuel tank 2.

The fuel flow rate into the pressurized line 14 from the second fuel pump 12 can be controlled by suitable switching of the control valve 50' according to the stroke of the pump plunger 12*p*. The fuel flow rate from the second fuel pump 12 into the pressurized line 14 can be controlled by controlling the control valve 50' so that the desired high pressure exists in the pressurized line 14, which can be sensed by the pressure sensor 48. The control valve 50' is controlled according to the pressure determined by the pressure sensor 48.

An additional return line 94 connects to the fuel line 10 from the pressurized line 14 with the reservoir 44. A pressure-limiting valve 96 is provided in the return line 94. The pressure-limiting valve 96 is provided so that, even if an error occurs, for example due to an error in the control valve 50', no dangerous excess pressure can exist in the fuel line 14. The pressure-limiting valve 96 can be controlled electrically, and indeed so that the pressure in the reservoir 44 can be quickly reduced according to the operating conditions.

When the shut off valve 30 is in its open position 30*a*, only a very reduced portion of the fuel flowing through the circulator line 52' flows through the scavenger line 60 into the fuel tank 2 as the throttle 84 and the pressure difference of the check valve 80 are adjusted to each other. The usually greater fuel flow flows through the check valve 80 in the fuel line 10, where the pressure damper 78 is provided, in order to provide a buffer reservoir for in-flowing pulsating fuel.

When the shut off valve 30 is put in its closed position 30*b*, the overpressure valve 7 determines the supply pressure in the fuel line 10. Because the overpressure valve 7 is set at a higher pressure than the pressure regulator valve 26, the supply pressure with the shut off valve 30 closed is higher than with it open. With the shut off valve 30 in its closed position the fuel flow flowing from the compression chamber 12*k* through the control valve 50' largely flows through the throttle 84, through the scavenger line 60 into the fuel line 22 and from there into the fuel tank 2.

When the internal combustion engine 32 is operating the second shut off valve 90 is in its open position 90*a*. If the internal combustion engine 32 is turned off, the second shut off valve 90 is switched into its closed position, in order to avoid a temporary pressure drop in the low pressure system by way of the gap between the pump plunger 12*p* and the pump housing 12*g*.

FIG. 11 shows an additional particularly advantageous preferred embodiment of the fuel supply apparatus according to the invention.

In the embodiment shown in FIG. 11 the leakage or bleeder line 88 leads to the fuel tank 2 without co-use of the return line 22, which differs from the embodiment shown in FIG. 9. The shut off valve 90 is provided in the leakage line 88. Because only a very reduced fuel flow rate through the leakage line 88 occurs, which is many times less than that through the return line 22, so that a very small and very light valve is suitable for use as the shut off valve 90.

FIG. 12 shows a further particularly advantageous preferred embodiment of the fuel supply apparatus according to the invention.

In the embodiment shown in FIG. 12 the shut off valve 30 is downstream of the pressure regulator valve 26, in contrast to other embodiments. The scavenger line 60 branches from the fuel line 10 at the branch point 63". The leakage or bleeder line 88 open to the scavenger line 60 downstream of the throttle 84. The opening 64, at which the scavenger line 60 opens into the return line 21, is between the pressure regulator valve 26 and the shut off valve 30.

The control valve 50' is connected with the fuel line 10 by means of the circulator line 52' and the opening 82. During the suction stroke of the fuel pump 10 the fuel can flow not only through inlet side check valve 12*a* with the control valve 50' open, but also through the control valve 50' into the compression chamber 12*k*. During the compression stroke of the fuel pump 12 the control valve 50' is kept in the closed position 50'*b* until the desired pressure is reached in the pressurized line 14.

Two dashed lines 98*r* and 98*f* are shown in FIG. 12. Usually parts found to the left of the dashed line 98*r* are found in the rear of the motor vehicle. Parts found to the right of the dashed line 98*f* are generally found in the front region of the motor vehicle.

Usually in order to connect the parts arranged in the front region of the vehicle with those in the rear region, comparatively long fuel lines are installed. For that reason the number of lines connecting the parts in the front with those in the rear are kept as small as possible. As can be seen from FIG. 12, the fuel line 10 and the scavenger line 60 are sufficient for connection of the parts in the front region with those in the rear region in this preferred embodiment.

In order to make restarting the internal combustion engine 32 easier, when the internal combustion engine 32 is shut off at comparatively high temperature, the following procedure is suggested: When the internal combustion engine 32 is shut off, keep the first fuel pump 6 in operation with the shut off valve 30 still open for a predetermined time interval, which can depend on the temperature. Heat energy collected from the region of the second fuel pump 12 and from the region of the fuel line 10 and the pressure damper 78 is transferred over the scavenger line 60 to the fuel tank 2. This avoids the danger of undesirable gas bubble formation in the fuel tank 2. Furthermore it can be provided that, after the rinsing or scavenging of the fuel line 10, shortly prior to shutting off the electrically operated fuel pump 6, the shut off valve 30 is switched into its closed position 30*b*. For that reason the pressure in the fuel line 10 and in the pressure damper 78 climbs to the supply pressure determined by the overflow valve 7, which is higher than the supply pressure determined by the pressure regulator valve 26 with the shut off valve 30 open. Because of that a higher pressure exists in the pressure damper 78 with the internal combustion engine shut off, which makes subsequent starting of the engine 32 easier, even at higher temperatures.

The embodiments shown in FIGS. 1 to 8 are especially used, when the second fuel pump 12 has several pump plungers 12*p*, usually three pump plungers 12*p*. The embodiments illustrated in FIGS. 9 to 12 are especially used when the second fuel pump 12 has a single pump plunger 12*p*.

The disclosure in German Patent Application 100 39 773.8 of Aug. 16, 2000 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in a fuel supply apparatus for an internal combustion engine, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

We claim:

1. A fuel supply apparatus for supplying fuel to an internal combustion engine, said fuel supply apparatus comprising at least one fuel valve (16) for introducing the fuel into the internal combustion engine;

a fuel tank (2);

a fuel line (10);

a first fuel pump (6) for supplying the fuel from the fuel tank (2) to the fuel line (10);

a second fuel pump (12) for supplying the fuel from the fuel line (10) via a pressurized line (14,42,44) to said at least one fuel valve (16) so that the fuel is introduced into the internal combustion engine at least indirectly;

a fuel return line (22) connecting the fuel line (10) to the fuel tank (2) for fuel return;

a pressure regulator valve (26) arranged in the fuel return line (22);

a shut off valve (30) arranged in the fuel return line (22) so as to be hydraulically in series with the pressure regulator valve (28); and a fuel scavenger line (60) for conducting the fuel back to the fuel tank (2) at least partially through the second fuel pump (12) and through a hydraulic resistance means;

wherein the fuel scavenger line (60) opens into the fuel return line (22) hydraulically between the shut off valve (30) and the pressure regulator valve (26).

2. The fuel supply apparatus as defined in claim 1, further comprising means for controlling the shut off valve (30) according to a temperature.

3. The fuel supply apparatus as defined in claim 1, wherein the second fuel pump (12) has a pump housing (12*g*) and the fuel scavenger line (60) extends through said pump housing (12*g*).

4. The fuel supply apparatus as defined in claim 3, wherein the second fuel pump (12) has a low pressure side (12*n*) and the fuel scavenger line (60) branches from the pump housing (12*g*) at a highest position thereof on said low pressure side (12*n*) of the second fuel pump.

5. The fuel supply apparatus as defined in claim 1, further comprising an overpressure valve (7) connected in parallel hydraulically to the pressure regulator valve (26).

6. The fuel supply apparatus as defined in claim 1, wherein the hydraulic resistance means comprises a throttle (70, 76, 84) having a flow-through resistance depending on the fluid flow flowing therethrough.

7. The fuel supply apparatus as defined in claim 1, wherein the hydraulic resistance means comprises a valve (61, 62, 68, 72) that opens depending on a pressure.

8. A fuel supply apparatus for supplying fuel to an internal combustion engine, said fuel supply apparatus comprising at least one fuel valve (16) for introducing the fuel into the internal combustion engine;

a fuel tank (2);

a fuel line (10);

a first fuel pump (6) for supplying the fuel from the fuel tank (2) to the fuel line (10);

a second fuel pump (12) for supplying the fuel from the fuel line (10) via a pressurized line (14,42,44) to said at least one fuel valve (16) so that the fuel is introduced into the internal combustion engine at least indirectly;

a fuel return line (22) connecting the fuel line (10) to the fuel tank (2) for fuel return;

a pressure regulator valve (26) arranged in the fuel return line (22);

a shut off Valve (30) arranged in the fuel return line (22) so as to be hydraulically in series with the pressure regulator valve (26);

a fuel scavenger line (60) for conducting the fuel back to the fuel tank (2) at least partially through the second fuel pump (12) and through a hydraulic resistance means; and a circulator line (52,52') connecting the pressurized line (14, 42, 44) to the fuel line (10) via a control valve (50,50'), said scavenger line (60) branching from the circulator line (52,52').

9. The fuel supply apparatus as defined in claim 8, further comprising means for controlling the shut off valve (30) according to a temperature.

10. The fuel supply apparatus as defined in claim 8, the second fuel pump (12) has a pump housing (12*g*) and the fuel scavenger line (60) extends through said pump housing (12*g*).

11. The fuel supply apparatus as defined in claim 10, wherein the second fuel pump (12) has a low pressure side (12*n*) and the fuel scavenger line (60) branches from the pump housing (12*g*) at a highest position thereof on said low pressure aide (12*n*) of the second fuel pump.

12. The fuel supply apparatus as defined in claim 8, wherein the hydraulic resistance means comprises a throttle (70, 76, 84) having a flow-through resistance depending on the fluid flow flowing therethrough.

13. The fuel supply apparatus as defined in claim 8, wherein the hydraulic resistance means comprises a valve (61, 62, 66, 72) that opens depending on a pressure.

14. The fuel supply apparatus as defined in claim 8, further comprising an overpressure valve (7) connected in parallel hydraulically to the pressure regulator valve (26).

15. The fuel supply apparatus as defined in claim 8, wherein the circulator line (52,52') is connected to the fuel line (10) by means of a hydraulic resistance element (53, 74,80).

16. The fuel supply apparatus as defined in claim 8, wherein the circulator line (52,52') is connected to the fuel line (10) by means of a check valve (53,80).

17. The fuel supply apparatus as defined in claim 16, further comprising a throttle (74) connected in parallel hydraulically to the check valve.

18. The fuel supply apparatus as defined in claim 8, wherein the second fuel pump (12) has a compression chamber (12*k*) and the circulator line (52') extends from the compression chamber (12*k*).

19. A fuel supply apparatus for supplying fuel to an internal combustion engine, said fuel supply apparatus comprising at least one fuel valve (16) for introducing the fuel into the internal combustion engine;

a fuel tank (2);

a fuel line (10);

a first fuel pump (6) for supplying the fuel from the fuel tank (2) to the fuel line (10);

a second fuel pump (12) for supplying the fuel from the fuel line (10) via a pressurized line (14,42,44) to said at least one fuel valve (16) so that the fuel is introduced into the internal combustion engine at least indirectly;

a fuel return line (22) connecting the fuel line (10) to the fuel tank (2) for fuel return;

a pressure regulator valve (26) arranged in the fuel return line (22);

a shut off valve (30) arranged in the fuel return line (22) so as to be hydraulically in series with the pressure regulator valve (26);

a fuel scavenger line (60) for conducting the fuel back to the fuel tank (2) at least partially through the second fuel pump (12) and through a hydraulic resistance means; and a leakage line (88) connecting the second fuel pump (12) to the fuel tank (2).

20. The fuel supply apparatus as define in claim 19, wherein the leakage line (88) opens into the return line (22) upstream of the shut off valve (30).

21. The fuel supply apparatus as defined in claim 19, further comprising means for controlling the shut off valve (30) according to a temperature.

22. The fuel supply apparatus as defined in claim 19, wherein the second fuel pump (12) has a pump housing (12*g*) and the fuel scavenger line (60) extends through said pump housing (12*g*).

23. The fuel supply apparatus as defined in claim 22, wherein the second fuel pump (12) has a low pressure side (12*n*) and the fuel scavenger line (60) branches from the pump housing (12*g*) at a highest position thereof on said low pressure side (12*n*) of the second fuel pump.

24. The fuel supply apparatus as defined in claim 19, further comprising an overpressure valve (7) connected in parallel hydraulically to the pressure regulator valve (26).

25. The fuel supply apparatus as defined in claim 19, wherein the hydraulic resistance means comprises a throttle (70, 76, 84) having a flow-through resistance depending on the fluid flow flowing therethrough.

* * * * *